US012484752B2

(12) United States Patent
Strauss et al.

(10) Patent No.: US 12,484,752 B2
(45) Date of Patent: Dec. 2, 2025

(54) PROJECTED DISPLAY FOR CLEANING STATION OF VACUUM ROBOT

(71) Applicant: Miele & Cie. KG, Gütersloh (DE)

(72) Inventors: Marion Karoline Strauss, Hamminkeln (DE); Carina Uphoff, Bielefeld (DE); Dominik Holz, Bielefeld (DE); Nicolas Stroop, Bielefeld (DE); Thomas Abel, Lüdenscheid (DE)

(73) Assignee: MIELE & CIE. KG, Guetersloh (DE)

( * ) Notice: Subject to any disclaimer, the term of this patent is extended or adjusted under 35 U.S.C. 154(b) by 332 days.

(21) Appl. No.: 17/993,098

(22) Filed: Nov. 23, 2022

(65) Prior Publication Data

US 2023/0157503 A1 May 25, 2023

(30) Foreign Application Priority Data

Nov. 23, 2021 (BE) ..... 2021/5910

(51) Int. Cl.
*A47L 9/28* (2006.01)
*A47L 11/40* (2006.01)

(52) U.S. Cl.
CPC ..... *A47L 9/2873* (2013.01); *A47L 11/4008* (2013.01); *A47L 2201/024* (2013.01)

(58) Field of Classification Search
CPC ..... A47L 9/2873; A47L 11/4008; A47L 2201/022; A47L 2201/024
See application file for complete search history.

(56) References Cited

U.S. PATENT DOCUMENTS 4,977,639 A * 12/1990 Takahashi ..... A47L 9/2847 15/319
2016/0037985 A1* 2/2016 Schultz ..... A47L 9/30 15/324
2016/0183752 A1* 6/2016 Morin ..... A47L 9/127 15/340.1
2018/0235423 A1 8/2018 Huang
(Continued)

FOREIGN PATENT DOCUMENTS

EP 1921523 A2 5/2008
EP 2023788 A2 2/2009
(Continued)

OTHER PUBLICATIONS

International Search Report dated Jul. 14, 2022.

*Primary Examiner* — C. A. Rivera
(74) *Attorney, Agent, or Firm* — Dickinson Wright PLLC

(57) ABSTRACT

A cleaning station for vacuum robots for cleaning floor surfaces, the cleaning station having a housing, the housing having an electrical interface, the interface being designed to contact a vacuum robot approaching the cleaning station for charging, the housing having a suction device, the suction device being designed to empty a vacuum robot approaching the cleaning station for emptying. The housing has at least one status display, the status display being designed to display an operating status of the interface and/or the suction device, wherein the status display comprises at least one projection apparatus. The projection apparatus is designed to project the operating status of the interface and/or the suction device onto the vacuum robot which has approached and/or onto the floor surface and/or onto a wall surface surrounding the cleaning station.

18 Claims, 6 Drawing Sheets

(56) References Cited

U.S. PATENT DOCUMENTS

| | | | | |
|---|---|---|---|---|
| 2019/0085852 | A1* | 3/2019 | Brown | A61L 9/122 |
| 2020/0069139 | A1* | 3/2020 | Johnson | A47L 9/1409 |

FOREIGN PATENT DOCUMENTS

| | | | | |
|---|---|---|---|---|
| EP | 3777629 | A1 | 2/2021 | |
| EP | 3942984 | A1 * | 1/2022 | A47L 11/4005 |
| KR | 20160008780 | A * | 1/2016 | |

* cited by examiner

PROJECTED DISPLAY FOR CLEANING STATION OF VACUUM ROBOT

RELATED APPLICATIONS

The present disclosure claims priority to and the benefit of Belgium Application 2021/05910 filed on Nov. 23, 2021, the entire contents of which are incorporated herein by reference.

TECHNICAL FIELD

The disclosure relates to a cleaning station for vacuum robots for cleaning floor surfaces, the cleaning station having a housing, the housing having an electrical interface, the interface being designed to contact a vacuum robot approaching the cleaning station for charging, the housing having a suction device, the suction device being designed to empty a vacuum robot approaching the cleaning station for emptying, the housing having at least one status display, the status display being designed to display an operating status of the interface and/or the suction device.

BACKGROUND

In homes, vacuum robots are used to clean surfaces such as textile flooring and smooth floors. In order to collect dust, a suction nozzle, designed as a floor nozzle, of the self-driving vacuum robot moves on a floor surface in a direction of travel. Rechargeable batteries for self-contained power supply of the vacuum robots during operation are periodically charged at electrical interfaces of cleaning stations. To this end, the cleaning stations are approached by the vacuum robots. In addition to the charging process of the rechargeable batteries, the vacuum robots can then also be emptied at the cleaning stations, meaning that the cleaning station removes collected dust from the vacuum robot that has traveled to the cleaning station. Cleaning stations known hitherto usually have only one light on the housing, which lights up during the emptying process. This kind of light is often difficult to see and not very useful. For electrical interfaces, often no status display at all is provided at the cleaning stations. The status in such cases can usually only be viewed via an app. In the event of failure, the cleaning station itself will not give any indication.

SUMMARY

Therefore, the problem addressed by the disclosure is to provide an improved cleaning station. This means providing a simple way of indicating the operating status of the cleaning station in an easily recognizable manner. In particular, the occurrence of faults should be clearly displayed.

According to the disclosure, this problem is solved by a cleaning station having the features of the independent claims. Because the status display comprises at least one projection apparatus and the projection apparatus is designed to project the operating status of the interface and/or the suction device onto the vacuum robot which has approached and/or onto the floor surface and/or onto a wall surface surrounding the cleaning station, sufficiently large display surfaces can be created by means of which the operating status of the cleaning station can be displayed in a clear and easily visible way. By projecting the operating status, the projection apparatus provides in a very simple manner sufficiently large display surfaces on the vacuum robot, the floor surface, and/or a nearby wall surface, thus providing an improved status display at the cleaning station. Via this status display, different operating statuses or operating states of the cleaning station can be visualized easily. For example, an ongoing and/or completed charging process can be displayed via the interface by projecting the operating status. An ongoing emptying process can also be displayed as an operating status via the suction device by projection. In addition, it is also possible to signal a suction device blockage or the need to empty the cleaning station by projection on the vacuum robot and/or on the floor surface and/or on a wall surface surrounding the cleaning station.

The floor surface can be formed by textile flooring, e.g. a carpet or carpet floor, or by a hard floor, e.g. wood parquet, laminate or PVC flooring.

The vacuum cleaner has a fan for generating a negative pressure by means of which the floor nozzle guided over a floor surface to be cleaned collects dust and dirt from the floor surface. For this purpose, the suction nozzle designed as a floor nozzle is automatically moved by the vacuum robot in the direction of travel. In this way, the floor nozzle glides over the floor surface to be cleaned. In particular, in the case of long-pile carpets the bottom of the floor nozzle glides over the carpet, while in the case of smooth floors the bottom floats over said floor surfaces at a distance. So that the flooring can be cleaned and maintained as effectively as possible, the suction opening in the floor nozzle is elongate and extends substantially transversely to the direction of travel. In this context, elongate means that the preferably substantially rectangular suction opening has a greater length transversely to the direction of travel than the width in the direction of travel. The suction opening is preferably between 15 and 25 cm long transversely to the processing direction. A vacuum cleaner housing of the vacuum cleaner can have a dust collection chamber in which the dust collected via the floor nozzle can accumulate.

Advantageous embodiments and developments of the disclosure result from the dependent claims. It should be noted that the features described individually in the claims can also be combined with one another in any desired and technologically useful way, thus demonstrating further embodiments of the disclosure.

According to an embodiment of the disclosure, the projection apparatus has a plurality of LED lights which are arranged side by side on the housing and are designed to be activated in order to project the operating status of the interface and/or the suction device. A two-dimensional projection or image for indicating operating states of the cleaning station can be very simply projected onto the vacuum robot which has approached and/or onto the floor surface and/or onto a wall surface surrounding the cleaning station via the LED lights arranged side by side on the projection apparatus. Arranging a plurality of LED lights arranged side by side on the display surface thus formed provides uniform illumination by projection. For this purpose, an auxiliary diffuser can also be used in front of the LED lights.

According to an advantageous embodiment of the disclosure, the projection apparatus has on the housing at least one light guide which is designed to be illuminated by at least one LED light arranged in the housing, the light guide being designed to emit light guided by the illumination for projecting the operating status of the interface and/or the suction device. The light guide is an easy way of achieving high degree of illumination of the display surface formed on the vacuum robot which has approached and/or on the floor surface and/or on the wall surface using as few LED lights as possible. In this way, the operating status of the interface and/or the suction device can be displayed particularly efficiently and clearly.

According to a preferred embodiment of the disclosure, the light guide is laid in a receiving trough in the housing, which trough is designed to be open in an emission direction for projecting the operating status of the interface and/or the suction device. In addition to securely fastening the light guide, laying the light guide in the receiving trough also serves to direct the emitted light toward the display surface formed by the projection on the vacuum robot which has approached and/or on the floor surface and/or on the wall surface.

According to a particularly advantageous development of the disclosure, the light guide has a plurality of notches, the notches being designed to refract the guided light and to emit it from the light guide in order to project the operating status of the interface and/or the suction device. By means of the notches in the light guide, it is possible to select very specifically the points at which the light guided by the light guide is refracted and guided out of the light guide in order to project the operating status. Thus, by changing the size and number of notches in each light guide portion, the amount of light emitted along the light guide for projection can be influenced in a very simple way. In this way, it is possible to achieve either relatively uniform illumination of the formed display surface or an intensity curve when illuminating the display surface formed by projection on the vacuum robot which has approached and/or on the floor surface and/or on the wall surface.

According to a further advantageous embodiment, the light guide extends in a U shape on a rear side of the housing. With a U-shaped light guide on the rear side of the housing, it is particularly easy to illuminate a wall surface facing the rear side in the vicinity of the cleaning station. Thus, operating states of the cleaning station can be particularly clearly displayed by means of projection on the wall surface facing the rear side.

According to an advantageous embodiment of the disclosure, the U-shaped light guide is designed to be illuminated by at least one LED light at each conductor end. Illumination of the U-shaped light guide can be achieved very simply by means of the LED lights at the conductor ends, so that a particularly efficient projection of the operating status on the wall surface normally facing the rear side can be achieved in the vicinity of the cleaning station.

According to an advantageous embodiment of the disclosure, at least one LED light is designed to be activated in order to generate light color and/or light intensity and/or light frequency. By changing the light color and/or light intensity and/or light frequency, the different operating statuses of the cleaning station can be indicated very vividly via the status display. In this way, the operating status of the interface and/or the suction device can be projected in a variety of ways on the vacuum robot which has approached and/or on the floor surface and/or on a wall surface surrounding the cleaning station. Thus, for example, it is possible to use a flashing red light to signal incorrect positioning of the vacuum robot on the interface. Using red flashing codes it is also possible to indicate various other cleaning station faults. The charging process of the vacuum robot via the interface could for example be shown on the display surface formed by the projection using a pulsing green light. In addition, for example, a blue light could be projected to indicate that the vacuum robot is just approaching the cleaning station.

According to a preferred embodiment of the disclosure, the projection apparatus is designed to project characters for indicating the operating status of the interface and/or the suction device. For this purpose, small LED projectors could be used which visualize the error messages of the cleaning station via the projected characters, for example. In addition, it is also conceivable to display other information, such as cleaning times, quantity, number, or status of the vacuum robots supervised by the cleaning station or locations of the vacuum robots.

In another embodiment, the brightness of the projection apparatus is automatically adapted to the ambient brightness. In a very dark environment, a status display that is too bright may be considered disturbing. Conversely, the same optical power may not be sufficient to achieve a satisfactory signal effect in the case of direct sunlight, or it may not be sufficient to attract the attention of a user who is present. To this end, a light sensor which continuously measures the ambient brightness is provided on the housing. The measured value is evaluated by a computing unit which can then increase or decrease the brightness of the projection apparatus. The basic relationships between the measured brightness and the brightness to be set are stored in a memory of the computing unit. Preferably the light sensor is positioned on the front side of the cleaning station and is advantageously unobstructed by the vacuum robot or by other components. This ensures that the sensor can best sense the ambient brightness and that the projection of the cleaning station cannot be disturbed.

The disclosure also relates to a cleaning system having a cleaning station as described in detail above and below and having a vacuum robot as described in detail above and below.

BRIEF DESCRIPTION OF THE DRAWINGS

Other features, details, and advantages of the disclosure are derived on the basis of the following description and with reference to the accompanying drawings. Exemplary embodiments of the disclosure are shown purely schematically in the following drawings and will be described in more detail below. Objects or elements corresponding to each other are provided with the same reference numerals throughout the drawings, in which.

DETAILED DESCRIPTION OF THE DRAWINGS

Figure 1:
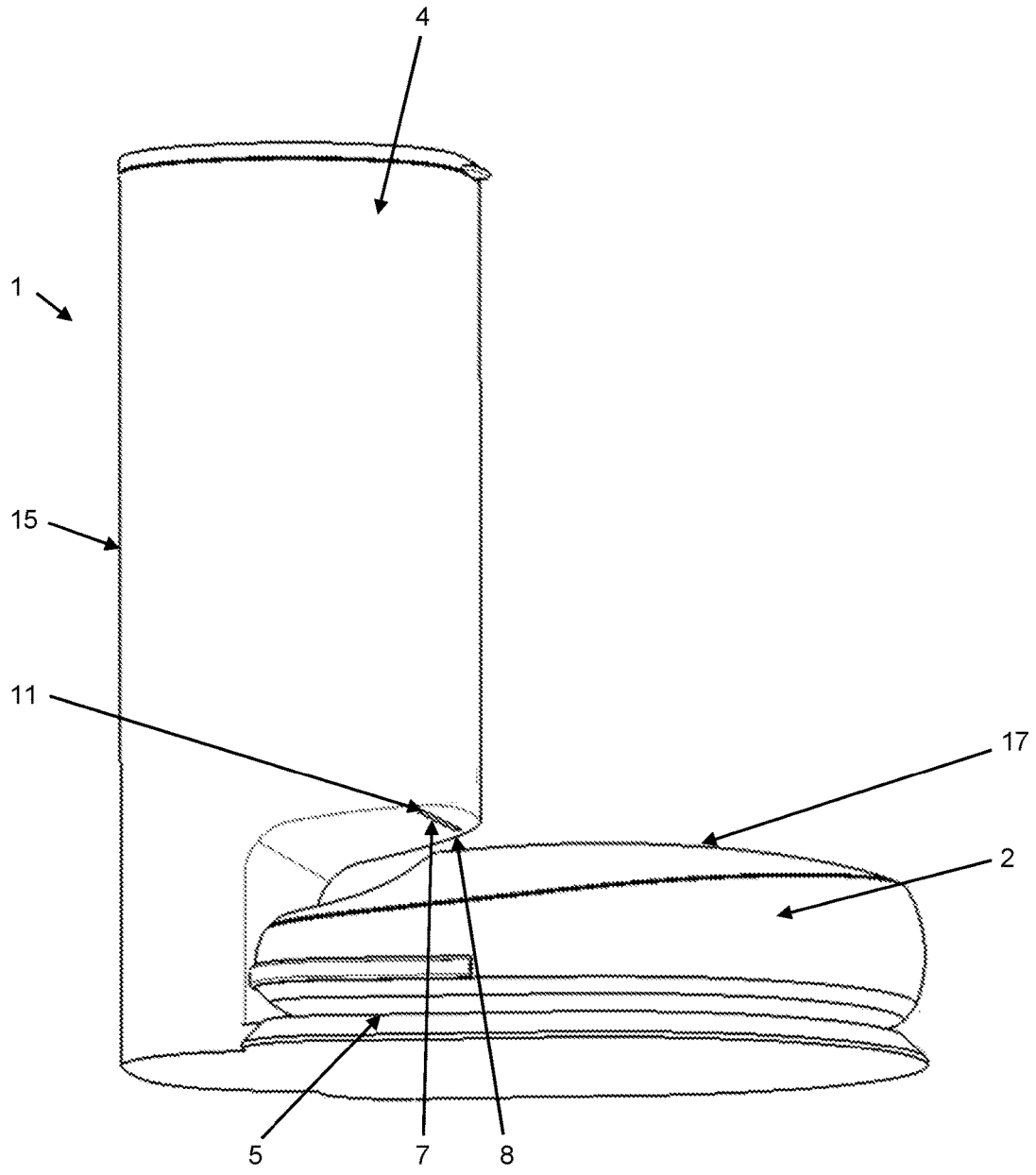
FIG. 1 shows a cleaning station according to the disclosure with a vacuum robot.

Referred to in the drawings by reference numeral 1, a cleaning station according to the disclosure with a vacuum robot 2 is shown purely schematically. The illustration according to FIG. 1 shows a cleaning station 1 having a housing 4. This housing 4 has an electrical interface 5 which is designed to contact the vacuum robot 2 which has approached the cleaning station 1 for charging, i.e. a vacuum robot 2 that is interfaced with or is otherwise engaged with the cleaning station 1. The housing 4 also has a vacuum or suction device 6 which serves to empty the vacuum robot 2. Furthermore, the housing 2 also has a status display 7 which is designed to display an operating status of the interface 5 and/or the suction device 6. The status display 7 comprises a projector or projection apparatus 8 which is designed to project an image of the operating status of the interface 5 and/or the suction device 6 onto the vacuum robot 2 which has approached and/or onto the floor surface 3 (FIG. 2) and/or onto a wall surface 9 (FIG. 2) surrounding or adjacent the cleaning station 1. In this way, sufficiently large display surfaces can be created by means of which the operating status of the cleaning station 1 can be displayed in a clear and easily visible way. FIG. 1 shows the preferred position of the projection apparatus 8 for projecting the operating status onto the vacuum robot 2 which has approached. Here, the projection apparatus 8 is arranged in the recessed part of the housing 4 for the vacuum robot 2. In this position, the top side 17 of the vacuum robot 2 can be used as a display surface by projecting the operating status when said vacuum robot has approached the cleaning station 1 for emptying and/or for charging.

Figure 2:
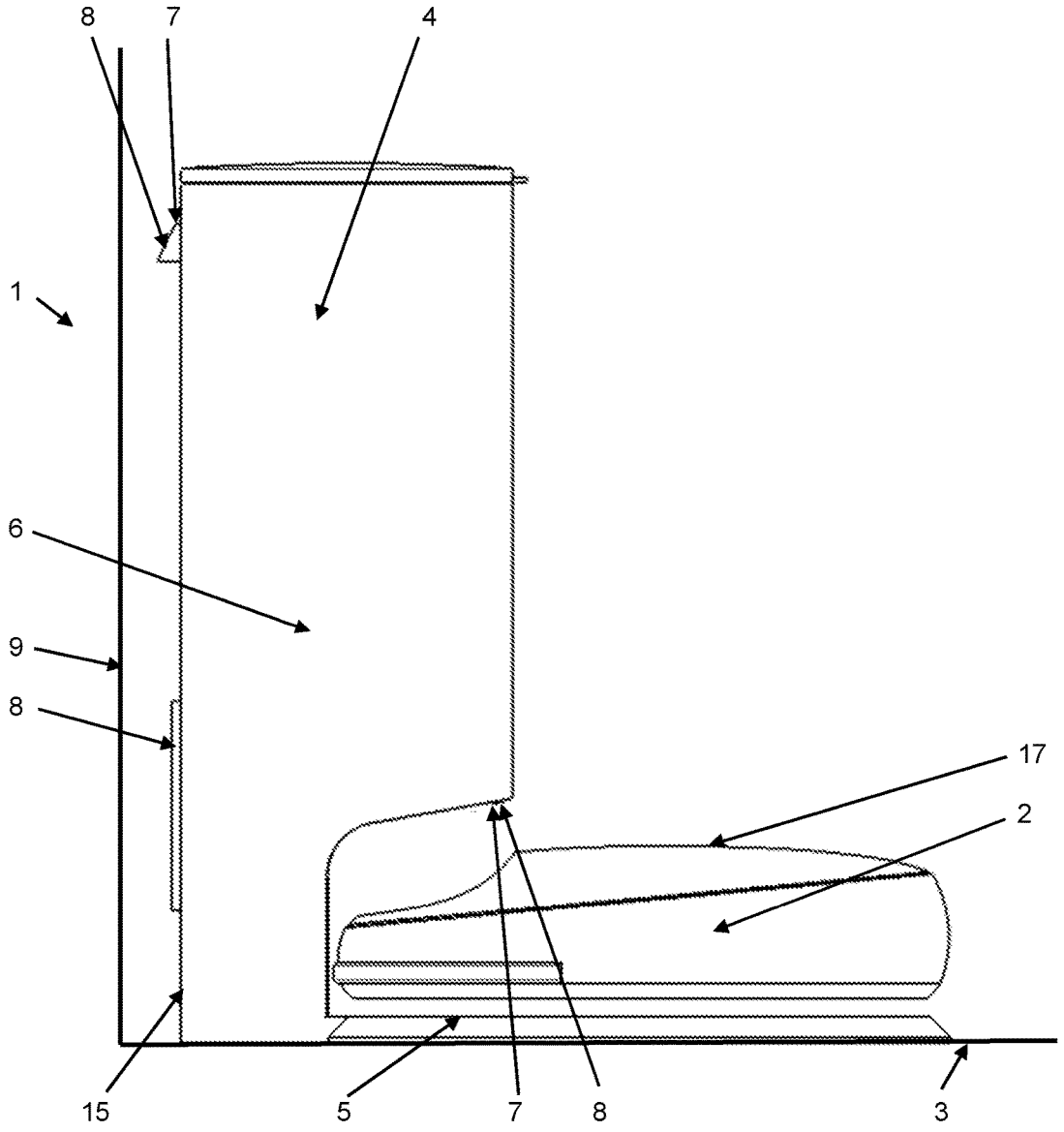
FIG. 2 is a side view of a cleaning station with a vacuum robot.

FIG. 2 is a side view of the cleaning station 1 according to FIG. 1. This illustration shows further preferred positions for projection apparatuses 8 for projecting the operating status of the interface 5 and/or the suction device 6 onto a wall surface 9 surrounding the cleaning station 1. In the illustration shown here the cleaning station 1 is placed, as usual, on the floor surface 3 at a wall 9 in the living space. The operating status of the interface 5 and/or the suction device 6 can be simply projected on the wall 9 facing the rear side 15 by means of the status display 7 projection apparatus 8 arranged on the rear side 15 of the housing 4. Because wall paints usually have a fairly bright surface, the projected light can be reflected easily.

Figure 3:
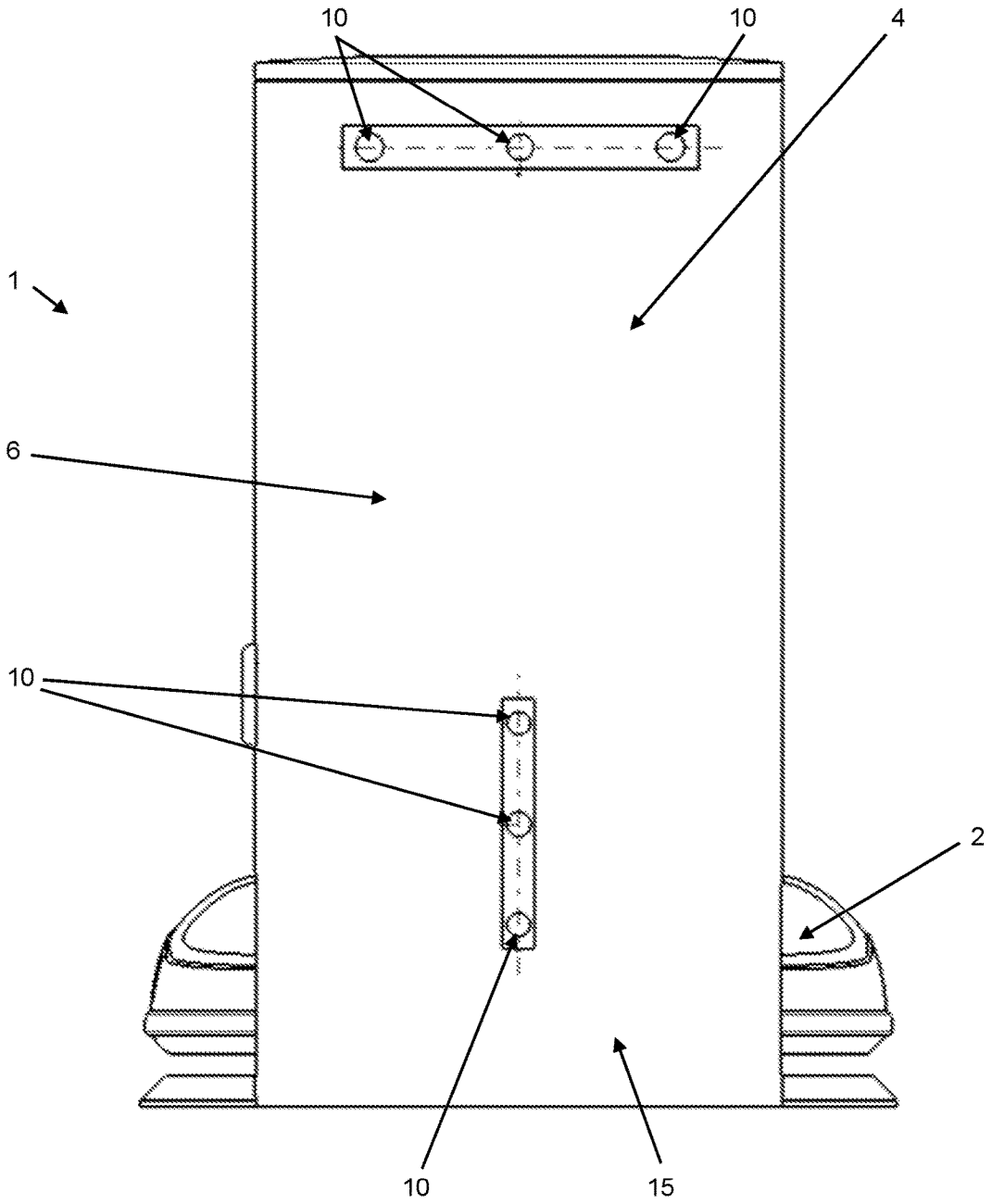
FIG. 3 is a rear view of a cleaning station with a vacuum robot.

FIG. 3 shows a rear view of the cleaning station 1 according to FIGS. 1 and 2. It can be seen from this illustration that the projection apparatuses 8 are formed by a plurality of LED lights 10 arranged side by side on the housing 4. Here, an upper projection apparatus 8 is formed by a horizontal light strip, while in the lower region of the rear side 15 of the housing 4, a vertical light strip is provided as a projection apparatus 8 having a plurality of LED lights 10 arranged side by side. The LED lights 10 are advantageously designed to be activated in order to generate light color and/or light intensity and/or light frequency. Thus, by changing the light color and/or light intensity and/or light frequency, different operating states of the cleaning station 1 can be projected very vividly onto the wall surface 9 (FIG. 2) behind the cleaning station 1.

Figure 4:
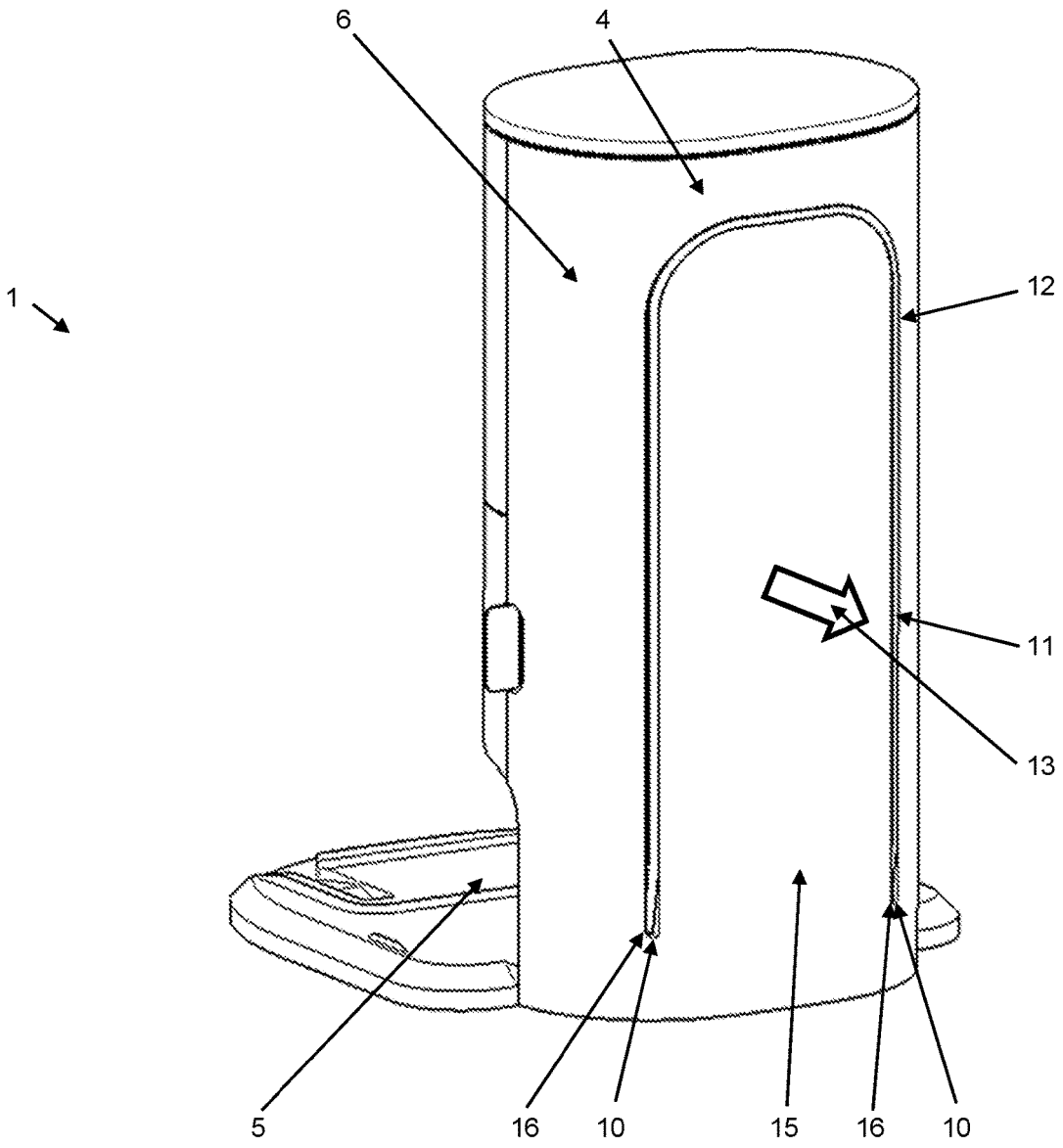
FIG. 4 shows another cleaning station with a light guide.

FIG. 4 shows an embodiment of the cleaning station 1 which has, as a projection apparatus 8, a light guide 11 on the housing 4. High illumination of the display surface formed on the wall surface 9 (FIG. 2) can be achieved via a light guide 11 having a small number of LED lights 10. In this way, the operating status of the interface 5 and/or the suction device 6 can be displayed particularly efficiently and clearly. The light guide 11 is illuminated by LED lights 10 arranged in the housing 4. Light guided by the light guide 11 is emitted by illumination of the light guide 11 for the projection of the operating status of the interface 5 and/or the suction device 6. The light guide 11 is advantageously laid in a U-shape along the rear side 15 of the housing 4. This U is flipped, e.g. upside down, in the embodiment shown. The U-shaped course on the rear side 15 of the housing 4 improves the illumination of the wall surface 9 (FIG. 2) behind the cleaning station 1. Thus, the operating status of the interface 5 and/or the suction device 6 can be particularly clearly shown by projection on the wall surface 9 facing the rear side 15 (FIG. 2). Since the U-shaped light guide 11 is illuminated by an LED light 10 arranged at each conductor end 16, only a small number of LED lights 10 are required to fully illuminate the wall surface 9 facing the rear side 15 (FIG. 2). The conductor ends 16 of the light guide 11 are preferably inclined inwardly so that light can be introduced into the interior of the cleaning station 1 by the LED lights 10. In this case, too, the LED lights 10 can be designed to be activated in order to generate light color and/or light intensity and/or light frequency. Thus, by changing the light color and/or light intensity and/or light frequency, different operating states of the cleaning station 1 can be projected very vividly onto the wall surface 9 (FIG. 2) behind the cleaning station 1. It is therefore possible to have a large amount of information about the operating status of the vacuum robot 2 and the cleaning station 1 in the field of view. The occurrence of faults or maintenance requirements can be displayed. For example, it is possible to indicate that the dust bag of the suction device 6 is full by the illumination/flashing of the light guide 11 in the color of a bag holding plate, or to indicate that the filter needs to be replaced by projecting the color of the filter of the suction device 6. As can be seen, the housing 4 has a receiving trough 12 in which the light guide 11 is laid. The receiving trough 12 is designed to be open in the emission direction 13 in order to project the operating status of the interface 5 and/or the suction device 6. The light guide 11 is securely arranged in the receiving trough 12 and the light emitted by the light guide 11 can simply be directed toward the wall surface 9 (FIG. 2), thereby preventing glare.

Figure 5:
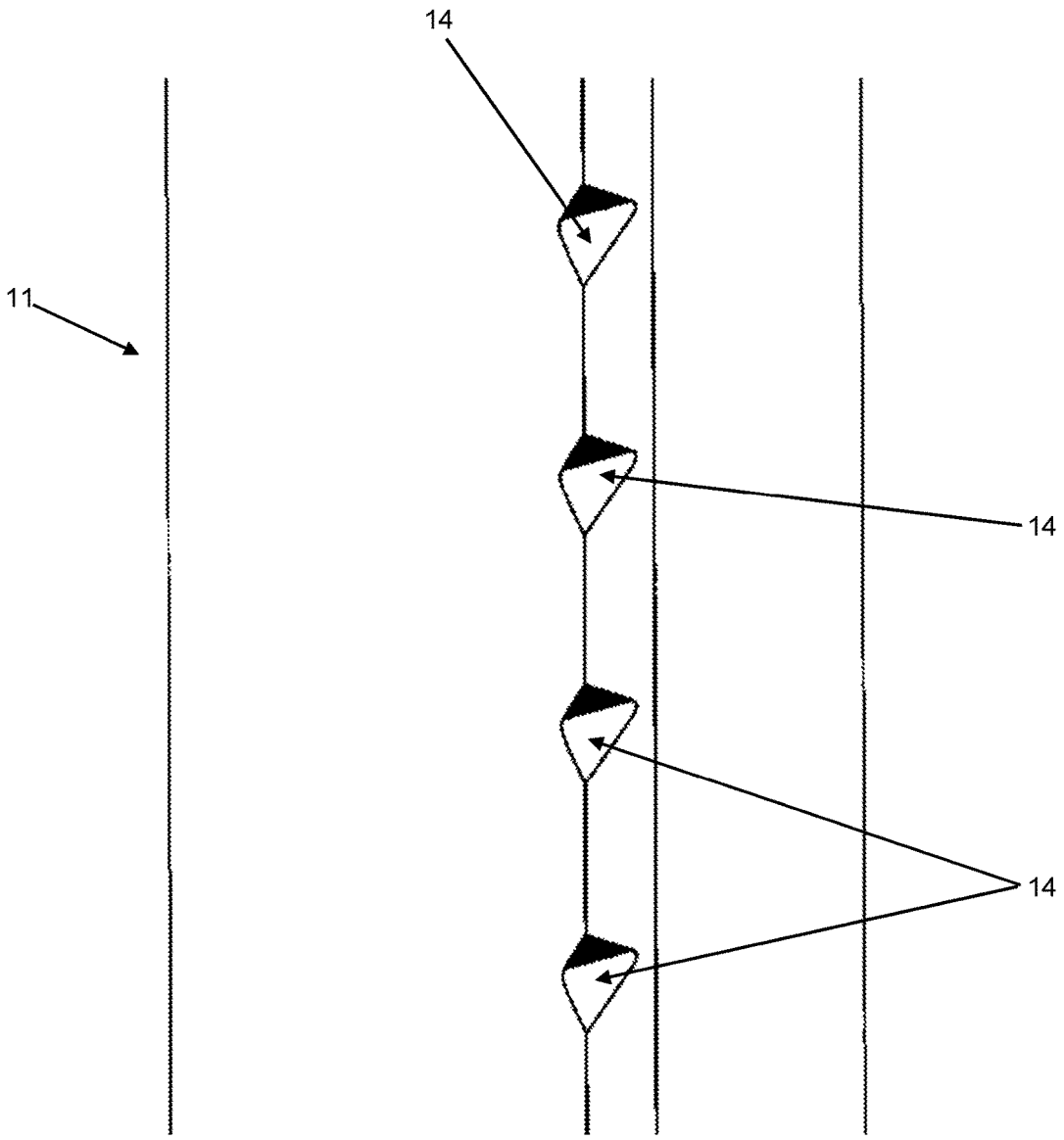
FIG. 5 is a detailed view of the light guide.
Figure 6:
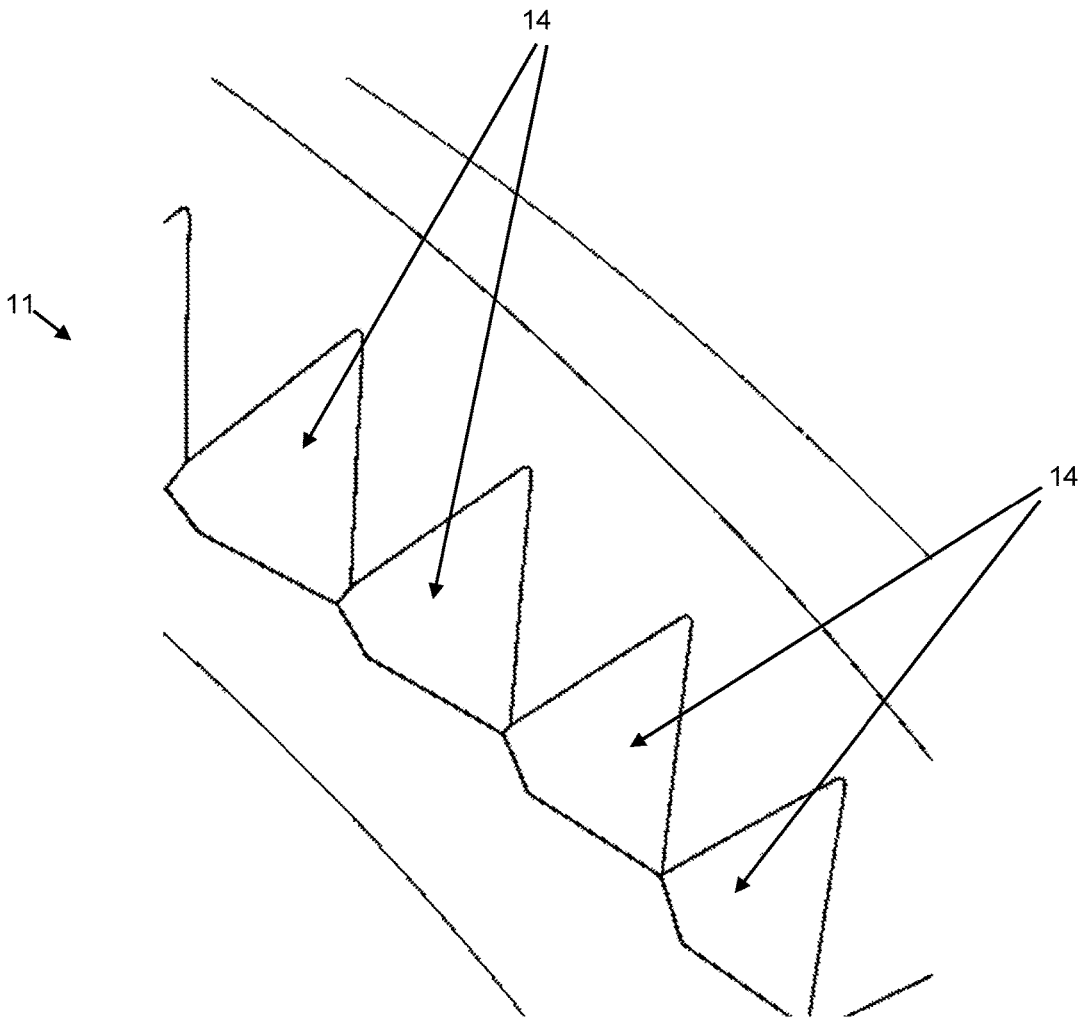
FIG. 6 is another detailed view of the light guide.

FIGS. 5 and 6 show detailed views of the light guide 11. These views show that the light guide 11 has a plurality of notches 14, the notches 14 being designed to refract the guided light and to emit it from the light guide 11 in order to project the operating status of the interface 5 and/or the suction device 6. By changing the size and number of notches 14 in each light guide portion, the amount of light emitted along the light guide 11 for projection can be influenced in a very simple way. In FIG. 5, small notches 14 emit a relatively small amount of light from the light guide 11 at relatively large spacings, while in FIG. 6 relatively large notches 14 are shown at relatively small spacings, thereby emitting a larger amount of light 11. Preferably, the upper region of the U-shaped light guide 11 (FIG. 4) is provided with relatively large notches 14 at relatively small spacings, while the lower region of the U-shaped light guide 11 (FIG. 4) is provided with relatively small notches 14 at relatively large spacings. In this way, uniform emission can be achieved on the light guide 11 by the LED lights 10 arranged at the lower conductor ends 16. The notches 14 are preferably arranged at regular intervals along an inner edge of the light guide 11. As the distance from the LED light 10 increases, the size of the notches 14 should increase. At the boundary surfaces of these notches 14 light exits the light guide 11 through partial transmission and is projected onto the wall surface 9 located therebehind (FIG. 2). The light is preferably diffusely reflected by the wall surface 9 (FIG. 2) and strikes the eye of an observer located in front of the cleaning station 1. In another advantageous embodiment, the contour of the light guide 11 projected onto the wall surface 9 (FIG. 2) approximates the outer contour of the cleaning station 11 projected onto the wall surface 9 (FIG. 2) so that the light output perceived by the observer is as uniform as possible around the cleaning station 11.

Of course, the disclosure is not limited to the illustrated exemplary embodiments. Other embodiments are possible without departing from the basic concept.

LIST OF REFERENCE NUMERALS

Cleaning station
Vacuum robot
Floor surface
Housing
Interface
Suction device
Status display
Projection apparatus
Wall surface
LED light
Light guide
Receiving trough
Emission direction
Notch
Rear side
Conductor end
Upper side

The invention claimed is:

1. A cleaning station for vacuum robots for cleaning floor surfaces, the cleaning station having a housing, the housing having an electrical interface, the interface being designed to contact a vacuum robot that has approached the cleaning station for charging, the housing having a vacuum, the vacuum being configured to empty a vacuum robot that has approached the cleaning station for emptying, the housing having at least one status display, the status display being designed to display an operating status of the interface and/or the vacuum, wherein the status display comprises at least one projector, the projector configured to project an image of the operating status of the interface and/or of the vacuum onto the vacuum robot which has approached and/or onto the floor surface and/or onto a wall surface adjacent the cleaning station, wherein the housing includes a recessed portion sized and positioned to receive at least part of the vacuum robot, the recessed portion including a downward facing wall, and wherein the projector is located in the downward facing wall and configured to project the image of the operating status onto the vacuum robot received in the recessed portion and/or onto the floor surface.

2. The cleaning station according to claim 1, wherein the projector has a plurality of LED lights which are arranged side by side on the housing and are configured to be activated in order to project the operating status of the interface and/or of the vacuum.

3. The cleaning station according to claim 1, wherein the projector has on the housing at least one light guide which is designed to be illuminated by at least one LED light arranged in the housing, the light guide being designed to emit light and guide an illumination for projecting an image of the operating status of the interface and/or of the vacuum.

4. The cleaning station according to claim 3, wherein the light guide is laid in a receiving trough in the housing, which trough is configured to be open in an emission direction for projecting the operating status of the interface and/or of the vacuum.

5. The cleaning station according to claim 3, wherein the light guide has a plurality of notches, the notches being configured to refract the guided light and to emit it from the light guide in order to project the operating status of the interface and/or of the vacuum.

6. The cleaning station according to claim 1, wherein the status display comprises a second projector having at least one light guide, the second projector configured to project an image of the operating status of the interface and/or of the vacuum onto a wall surface adjacent the cleaning station, the light guide extending in a U shape on a rear side of the housing.

7. The cleaning station according to claim 6, wherein the U-shaped light guide is configured to be illuminated by at least one LED light positioned at each end of the U shape.

8. The cleaning station according to claim 2, wherein at least one LED light is configured to be activated in order to generate light color and/or light intensity and/or light frequency.

9. The cleaning station according to claim 1, wherein the projector is configured to project characters for indicating the operating status of the interface and/or of the vacuum.

10. A cleaning system having the cleaning station according to claim 1 and further comprising a vacuum robot.

11. The cleaning station according to claim 1, wherein the housing includes a rear side wall that is vertically oriented relative to the floor surface, and wherein another projector is located in the rear side wall and configured to project the image of the operating status onto the a wall surface behind the cleaning station.

12. A cleaning station for vacuum robots for cleaning floor surfaces, the cleaning station having a housing, the housing having an electrical interface, the interface being designed to contact a vacuum robot that has approached the cleaning station for charging, the housing having a vacuum, the vacuum being configured to empty a vacuum robot that has approached the cleaning station for emptying, the housing having at least one status display, the status display being designed to display an operating status of the interface and/or the vacuum, wherein the status display comprises at least one projector, the projector configured to project an image of the operating status of the interface and/or of the vacuum onto the vacuum robot which has approached and/or onto the floor surface and/or onto a wall surface adjacent the cleaning station, wherein the projector has on the housing at least one light guide which is designed to be illuminated by at least one LED light arranged in the housing, the light guide being designed to emit light and guide an illumination for projecting an image of the operating status of the interface and/or of the vacuum, wherein the light guide extends in a U shape on a rear side of the housing, wherein the U-shaped light guide is upside down relative to the floor surface such that an open end of the U-shaped light guide points downwardly.

13. The cleaning station according to claim 12, wherein the light guide is laid in a receiving trough in the housing, which trough is configured to be open in an emission direction for projecting the operating status of the interface and/or of the vacuum.

14. The cleaning station according to claim 13, wherein the at least one light guide has a plurality of notches, the notches being configured to refract the guided light and to emit it from the light guide in order to project the operating status of the interface and/or of the vacuum.

15. The cleaning station according to claim 14, wherein the at least one LED includes first and second LEDs positioned at each end of the trough.

16. The cleaning station according to claim 12, wherein the at least one LED light is configured to be activated in order to generate light color and/or light intensity and/or light frequency.

17. The cleaning station according to claim 12, wherein the projector is configured to project characters for indicating the operating status of the interface and/or of the vacuum.

18. The cleaning station according to claim 12, wherein the wall surface is behind the cleaning station.

* * * * *